US008013816B2

(12) United States Patent
Kim

(10) Patent No.: US 8,013,816 B2
(45) Date of Patent: Sep. 6, 2011

(54) LIGHT EMITTING DISPLAY

(75) Inventor: Yang-Wan Kim, Suwon-si (KR)

(73) Assignee: Samsung Mobile Display Co., Ltd., Yongin (KR)

( * ) Notice: Subject to any disclaimer, the term of this patent is extended or adjusted under 35 U.S.C. 154(b) by 1210 days.

(21) Appl. No.: 11/165,162

(22) Filed: Jun. 22, 2005

(65) Prior Publication Data

US 2006/0001622 A1 Jan. 5, 2006

(30) Foreign Application Priority Data

Jun. 30, 2004 (KR) ..... 10-2004-0050669
Jun. 30, 2004 (KR) ..... 10-2004-0050670
Jun. 30, 2004 (KR) ..... 10-2004-0050671

(51) Int. Cl.
*G09G 3/32* (2006.01)

(52) U.S. Cl. ..... 345/82

(58) Field of Classification Search ..... 345/76, 345/82–83, 204–205; 315/169.3; 349/54–55, 349/150–151; 324/770
See application file for complete search history.

(56) References Cited

U.S. PATENT DOCUMENTS 4,843,312 A * 6/1989 Hartman et al. ..... 324/770
4,924,589 A * 5/1990 Leedy ..... 438/6
5,289,586 A * 2/1994 Umekita et al. ..... 710/305
5,504,348 A * 4/1996 Yoshida et al. ..... 257/59
5,530,568 A * 6/1996 Yamamoto et al. ..... 349/143
5,546,013 A * 8/1996 Ichioka et al. ..... 324/770
5,657,139 A * 8/1997 Hayashi ..... 349/40
5,748,267 A * 5/1998 Natori et al. ..... 349/40
5,811,837 A * 9/1998 Misawa et al. ..... 257/72
5,868,951 A * 2/1999 Schuck et al. ..... 216/24
6,097,362 A * 8/2000 Kim ..... 345/87
6,188,453 B1 * 2/2001 Matsuoka et al. ..... 349/54
6,665,045 B2 * 12/2003 Kanayama ..... 349/192
2001/0020988 A1 * 9/2001 Ohgiichi et al. ..... 349/54
2001/0022565 A1 * 9/2001 Kimura ..... 345/82
2002/0030647 A1 * 3/2002 Hack et al. ..... 345/82
2002/0051114 A1 * 5/2002 Kwak et al. ..... 349/192
2003/0155943 A1 * 8/2003 Morishita ..... 324/770
2003/0173991 A1 * 9/2003 Takafuji et al. ..... 324/770
2003/0179164 A1 * 9/2003 Shin et al. ..... 345/76
2003/0180975 A1 * 9/2003 Fujita ..... 438/17
2004/0056852 A1 * 3/2004 Shih et al. ..... 345/204
2004/0095549 A1 * 5/2004 Moon ..... 349/192
2004/0174183 A1 * 9/2004 Nojiri et al. ..... 324/770
2004/0183563 A1 * 9/2004 Her et al. ..... 324/770
2005/0078057 A1 * 4/2005 Chang et al. ..... 345/55
2006/0001792 A1 * 1/2006 Choi ..... 349/54

* cited by examiner

*Primary Examiner* — Chanh Nguyen
*Assistant Examiner* — Robert Stone
(74) *Attorney, Agent, or Firm* — Christie, Parker & Hale, LLP

(57) ABSTRACT

A light emitting display includes a scan driver for generating a selection signal and applying it to a scan line, and a data driver for generating a data signal and applying it to a data line. The scan and data drivers are formed on the same substrate with the display area in which pixels are arranged in a matrix format. The data driver includes a shift register for generating shift signals shifted to sequentially have a first level and for outputting the shift signals through a plurality of output terminals, a plurality of test pads formed to be coupled to the plurality of output terminals of the shift register, and a demultiplexer for selectively applying the data signal input through a plurality of data buses to the data line in response to the first level of the shift signals.

14 Claims, 13 Drawing Sheets

LIGHT EMITTING DISPLAY

CROSS REFERENCES TO RELATED APPLICATIONS

This application claims priority to and the benefit of Korean Patent Application Nos. 10-2004-0050669, 10-2004-0050670 and 10-2004-0050671 filed in the Korean Intellectual Property Office on the same day of Jun. 30, 2004, the entire contents of all of which are incorporated herein by reference.

BACKGROUND OF THE INVENTION

1. Field of the Invention

The present invention relates to a light emitting display. More specifically, the present invention relates to an organic light emitting diode (OLED) display including a test pad.

2. Discussion of the Related Art

In general, a flat panel display (FPD) is a display device in which walls are provided between two substrates to manufacture an airtight device, and appropriate elements are arranged in the airtight device to display desired images. The importance of the FPD has been emphasized following the development of multimedia technologies. In response to this trend, various flat displays such as the liquid crystal display (LCD), the organic light emitting diode (OLED) display, and the field emission display (FED) have been put to practical use. In particular, the OLED display including an organic light emitting diode has been developed.

Generally, OLED displays emit light by electrically exciting an organic compound. An OLED display includes N×M organic light emitting cells arranged in the form of a matrix, and displays an image by driving the organic light emitting cells, using voltage or current. Such organic light emitting cells are also referred to as "organic light emitting diodes (OLEDs)" because they have diode characteristics. As shown in FIG. 15, an organic light emitting cell (or OLED) has a structure including an anode electrode layer (e.g., indium tin oxide: ITO), an organic layer, and a cathode electrode (e.g., metal) layer. To achieve an improved balance between electrons and holes, and thus, an enhancement in light emitting efficiency, the organic layer has a multi-layer structure including an emitting layer (EML), an electron transport layer (ETL), and a hole transport layer (HTL). The organic layer also includes an electron injecting layer (EIL) and a hole injecting layer (HIL). Several organic light emitting cells are arranged in the form of an M×N matrix to form an OLED display panel.

Methods for driving an OLED display panel include a passive matrix type driving method and an active matrix type driving method using thin film transistors (TFTs). In the passive matrix type driving method, anodes and cathodes are arranged to be orthogonal to each other so that a desired line to be driven can be selected. In the active matrix type driving method, thin film transistors are coupled to respective indium tin oxide (ITO) pixel electrodes in an OLED display panel so that the OLED display panel is driven by a voltage maintained by the capacitance of a capacitor coupled to the gate of each thin film transistor.

FIG. 1 shows a pixel circuit of an OLED display to be driven by the active matrix type driving method. The pixel circuit of the OLED display includes an organic light emitting cell OLED, two transistors SM and DM, and a capacitor Cst. A power voltage VDD is coupled to a source of the driving transistor DM, and a capacitor is coupled between the source and a gate of the transistor DM. The capacitor Cst maintains a gate-source voltage $V_{GS}$ of the driving transistor DM for a predetermined period. The switching transistor SM transmits a data voltage from a data line $D_m$ to the gate of the transistor DM with response to a selection signal from a present scan line $S_n$. A cathode of the cell OLED is coupled to a reference voltage Vss, and the cell OLED emits a light corresponding to a current applied through the driving transistor DM.

The conventional OLED display has a configuration in which a high density integrated circuit is coupled to an array substrate in which pixels are arranged using a tape automated bonding (TAB) method. In the conventional OLED display in which the driving circuit is coupled to the array substrate using the TAB method, multiple leads for coupling the array substrate to the driving circuit are required; therefore, it is difficult to manufacture the conventional OLED display, and reliability of the display may be reduced. In addition, the cost of the conventional OLED display is high because of the high cost of the high-density integrated circuit.

Accordingly, an OLED display including a driving circuit directly accumulated on a pixel array substrate in which a pixel circuit is arranged has been developed. The OLED display manufactured by directly accumulating the driving circuit to the pixel array substrate is referred to as a chip on glass (COG) type OLED display or a system on panel (SOP) type OLED display. The reliability of the product is increased in the COG or SOP type OLED display because the additional process of coupling the driving circuit to the pixel array substrate is not necessary.

Typically, it is not difficult to test an operation of a driving circuit when the driving circuit uses an additional high-density integrated circuit. However, it is difficult to test an operation of a driving circuit when the driving circuit is accumulated on the substrate of a COG or SOP type OLED display.

SUMMARY OF THE INVENTION

An embodiment of the present invention provides a chip on glass (COG) type light emitting or OLED display with a test pad coupled to an output terminal of a driving circuit of the display in order to test the driving circuit.

One embodiment of the present invention provides a light emitting display. The light emitting display includes: a display area including a plurality of scan lines for transmitting selection signals, a plurality of data lines for transmitting data signals, and a plurality of pixels arranged in a matrix format and respectively coupled to the scan lines and the data lines, the display area being formed on a same substrate; a scan driver for generating the selection signals and respectively applying the selection signals to the scan lines, the scan driver being formed on the same substrate; and a data driver for generating the data signals and for respectively applying the data signals to the data lines, the scan driver being formed on the same substrate.

In this embodiment, the data driver includes: a shift register for generating shift signals shifted to sequentially have a first level and for outputting the shift signals through a plurality output terminals; a plurality of test pads respectively coupled to the plurality of output terminals of the shift register; and a demultiplexer for selectively applying the data signals input through a plurality of data buses to the data lines in response to the first level of the shift signals.

One embodiment of the present invention provides a light emitting display. The light emitting display includes: a plurality of scan lines for transmitting selection signals; a plurality of data lines for transmitting data signals; a plurality of pixels respectively coupled to the scan lines and the data lines, and arranged in a matrix format; and a data driver for generating the data signals and for respectively applying the data signals to the data lines.

In this embodiment, the data driver includes: a shift register for generating shift signals shifted to sequentially have a first level and for outputting the shift signals; a buffering unit for buffering the shift signals output from the shift register, the buffering unit comprising a plurality of output terminals for outputting the buffered shift signals; and a test pad coupled to each of the output terminals of the buffering unit.

One embodiment of the present invention provides a data driver for forming on a pixel array substrate in which a pixel displaying an image data with reference to a data signal applied through a data line is arranged in a matrix format with a plurality of other pixels. The data driver includes: a shift register for generating a plurality of shift signals shifted to sequentially have a first level and for outputting the shift signals; a buffering unit including a plurality of buffering circuits for receiving the plurality of shift signals output from the shift register, the buffering unit being for buffering the shift signals and for outputting the shift signals, the plurality of buffering circuits comprising a plurality of output terminals; a test pad formed to be coupled to each of the output terminals of the plurality of buffering circuits; and a demultiplexer for selectively applying the data signal input through at least one of a plurality of data buses to the data line in response to the first level of at least one of the plurality of shift signals output from the buffering unit.

One embodiment of the present invention provides a light emitting display. The light emitting display includes: a display area including a plurality of scan lines for transmitting selection signals, a plurality of data lines for transmitting data signals, and a plurality of pixels arranged in a matrix format and respectively coupled to the scan lines and the data lines, the display area being formed on a same substrate; a scan driver for generating the selection signals and for respectively applying the selection signals to the scan lines, the scan driver being formed on the same substrate; and a data driver for generating the data signals and for respectively applying the data signals to the data lines, the scan driver being formed on the substrate.

In this embodiment, the data driver includes: a shift register for generating a plurality of shift signals shifted to sequentially have a first level and for respectively outputting the shift signals through a plurality of output terminals of the shift register; a demultiplexer for selectively applying the data signal input through a plurality of data buses to the data lines through a plurality of output terminals of the demultiplexer in response to the first level of the shift signal; and a plurality of test pads formed to be coupled between the output terminals of the demultiplexer and the data lines.

One embodiment of the present invention provides a data driver for forming on a pixel array substrate in which a pixel displaying an image data with reference to a data signal applied through a data line is arranged in a matrix format with a plurality of other pixels. The data driver includes: a shift register for generating a plurality of shift signals shifted to sequentially have a first level and for respectively outputting the shift signals; a buffering unit including a plurality of buffering circuits for receiving the plurality of shift signals output from the shift register, the buffering unit being for buffering the shift signals and for outputting the shift signals; a demultiplexer for selectively applying the data signal input through at least one of a plurality of data buses to the data line through at least one of a plurality of output terminals of the demultiplexer in response to the first level of the shift signal output from the buffering unit; and a test pad formed to be coupled to the output terminals of the demultiplexer.

One embodiment of the present invention provides a light emitting display. The light emitting display includes: a display area including a plurality of scan lines for transmitting selection signals, a plurality of data lines for transmitting data signals, and a plurality of pixels arranged in a matrix format and respectively coupled to the scan lines and the data lines, the display area being formed on a substrate; a scan driver for generating the selection signals and for respectively applying the selection signals to the scan lines, the scan driver being formed on the substrate; and a data driver for generating the data signals and for applying the data signals to the data lines, the scan driver being formed on the substrate.

In this embodiment, the scan driver includes: a shift register for generating the selection signals shifted to sequentially have a first level and for respectively outputting the selection signals through a plurality of output terminals; and a plurality of test pads formed to be coupled to the plurality of output terminals of the shift register.

One embodiment of the present invention provides a light emitting display. The light emitting display includes: a plurality of scan lines for transmitting selection signals; a plurality of data lines for transmitting data signals; a plurality of pixels respectively coupled to the scan lines and the data lines, and arranged in a matrix format; and a scan driver for generating the selection signals and for applying the selection signals to the scan lines.

In this embodiment, the scan driver includes: a shift register for generating the selection signals shifted to sequentially have a first level and for respectively outputting the selection signals through a plurality of output terminals; and a plurality of test pads formed to be respectively coupled to the plurality of output terminals of the shift register.

BRIEF DESCRIPTION OF THE DRAWINGS

The accompanying drawings, together with the specification, illustrate exemplary embodiments of the present invention, and, together with the description, serve to explain the principles of the invention.

DETAILED DESCRIPTION

Figure 1:
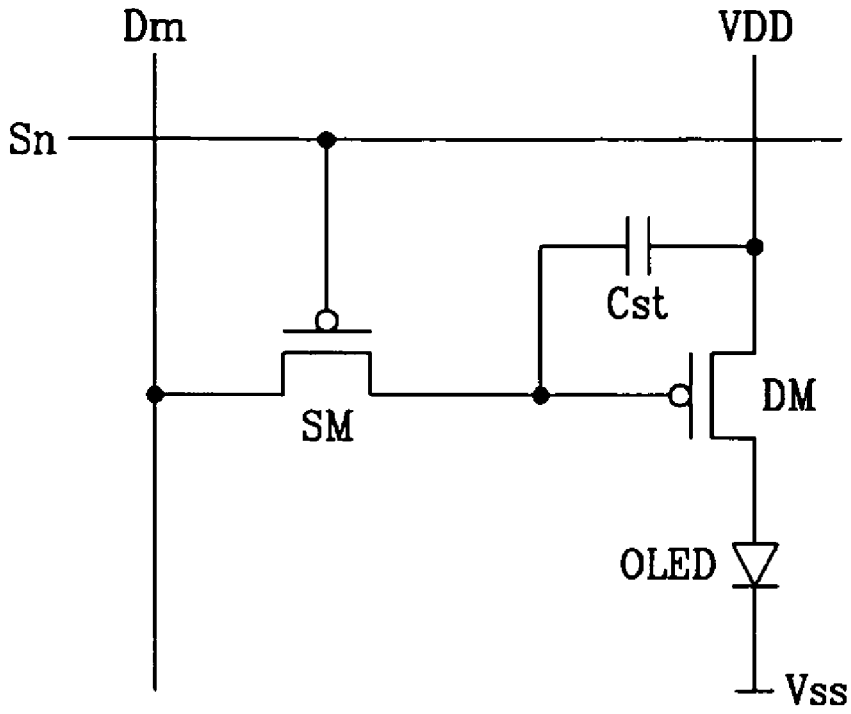
FIG.1 (Prior Art)
FIG. 1 shows a pixel circuit driven by an passive active matrix type driving method.

In the following detailed description, exemplary embodiments of the present invention are shown and described, by way of illustration. As those skilled in the art would recognize, the described exemplary embodiments may be modified in various ways, all without departing from the spirit or scope of the present invention. Accordingly, the drawings and description are to be regarded as illustrative in nature, rather than restrictive. There may be parts shown in the drawings, or parts not shown in the drawings, that are not discussed in the specification, as they are not essential to a complete understanding of the invention. Like reference numerals designate like elements.

Figure 2:
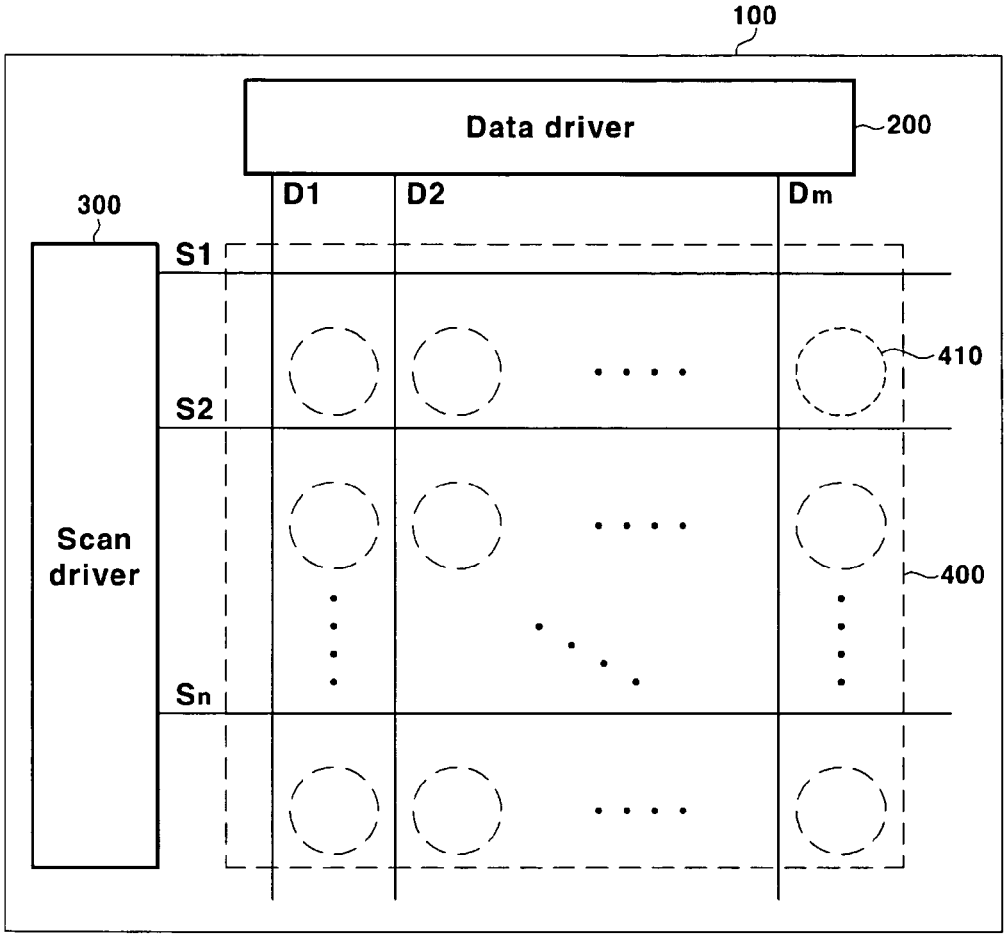
FIG. 2 shows a configuration of an OLED display according to an exemplary embodiment of the present invention.

FIG. 2 shows a configuration of an OLED display according to an exemplary embodiment of the present invention. The OLED display includes a data driver 200, a scan driver 300, and a display area 400 that are all formed on a glass substrate 100.

The display area 400 includes a plurality of data lines D1 to Dm arranged in a column direction, a plurality of scan lines S1 to Sn arranged in a row direction, and a plurality of pixel circuits 410. The data lines D1 to Dm are used for transmitting data signals for representing image signals to the pixel circuits 410, and the scan lines S1 to Sn are used for transmitting selection signals to the pixel circuits 410. A pixel circuit 410 is formed in a pixel area which is defined by two neighboring data lines D1 to Dm and two neighboring scan lines S1 to Sn.

The data driver 200 applies data signals corresponding to red, green, and blue image signals to the data lines D1 to Dm in the display area 400. The scan driver 300 sequentially generates the selection signals and applies the signals to the scan lines S1 to Sn in the display area 400.

As shown, the OLED or light emitting display according to the present invention is a chip on glass (COG) type OLED or light emitting display in which the display area 400 and the driving circuits (e.g., drivers 200 and 300) are formed on the substrate 100.

Figure 3:
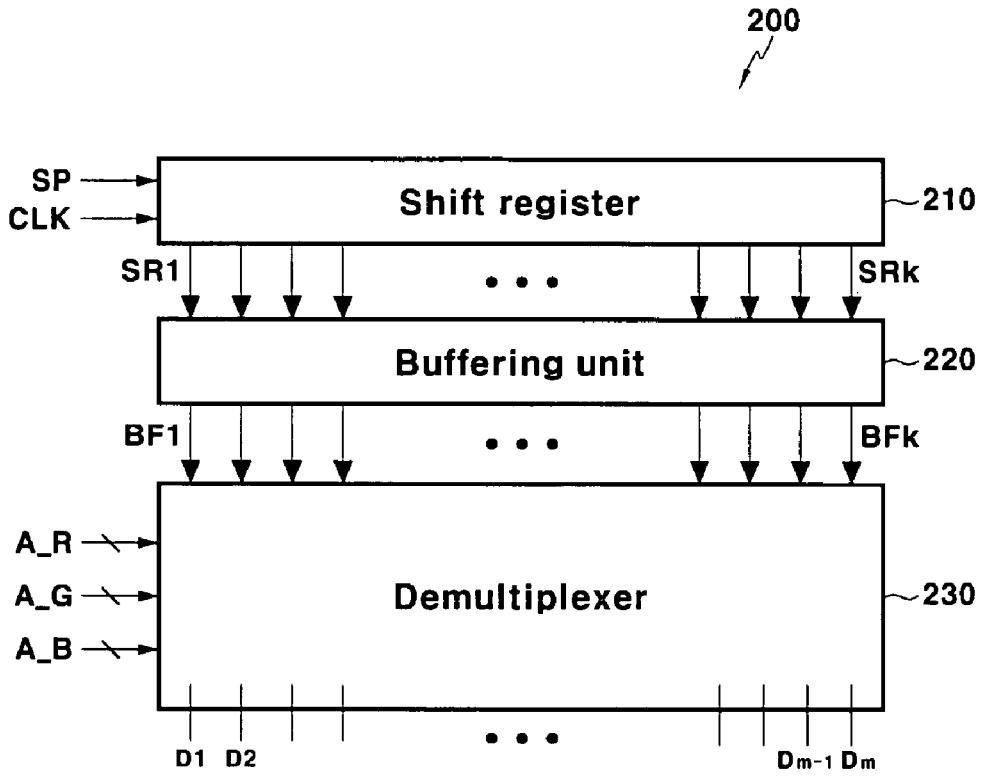
FIG. 3 shows a configuration of the data driver of FIG. 2.

FIG. 3 shows a configuration of the data driver 200 of FIG. 2. As shown, the data driver 200 includes a shift register 210, a buffering unit 220, and a demultiplexer 230. The shift register 210 receives a clock signal CLK and a start signal SP and sequentially generates signals SR1 to SRk shifted at a predetermined interval. The buffering unit 220 buffers the signals sequentially shifted and output from the shift register 210 in order to transmit signals without distortion, and outputs signals BF1 to BFk. The demultiplexer 230 receives red, green, and blue data signals A_R, A_G, and A_B converted into analog data (from digital data), and sequentially applies the data signals to corresponding data lines D1, D1, . . . Dm−1, Dm with reference to the signals BF1 to BFk sequentially output from the buffering unit 220.

Figure 4:
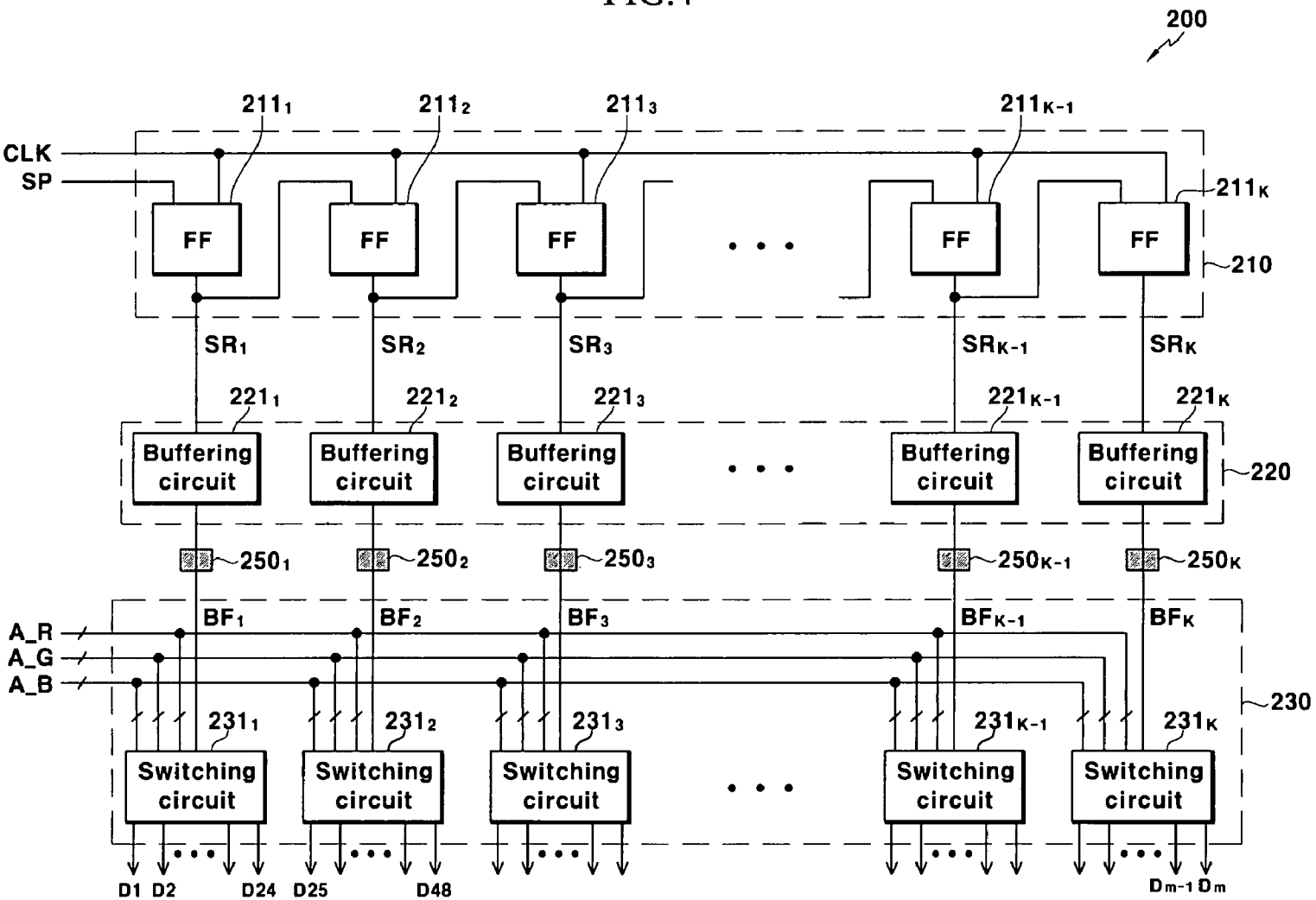
FIG. 4 shows a detailed diagram for representing the configuration of the data driver of FIG. 3 according to a first exemplary embodiment of the present invention.

FIG. 4 shows a detailed diagram for representing the configuration of the data driver 200 of FIG. 3 according to a first exemplary embodiment of the present invention.

As shown in FIG. 4, the shift register 210 includes a plurality of flip-flops $\mathbf{211}_1$ to $\mathbf{211}_k$, and the buffering unit 220 includes a plurality of buffering circuits $\mathbf{221}_1$ to $\mathbf{221}_k$. The demultiplexer 230 includes a plurality of switching circuits $\mathbf{231}_1$ to $\mathbf{231}_k$.

The flip-flop $\mathbf{211}_1$ receives a clock signal CLK and a start signal SP, and generates a signal SR1 having a low level for a predetermined period. The flip-flop $\mathbf{211}_2$ receives the clock signal CLK and the signal SR1 output from the flip-flop $\mathbf{211}_1$, and outputs a signal SR2 which is generated by shifting of the signal SR1 having the low level. In the like manner, the flip-flop $\mathbf{211}_k$ receives the clock signal CLK and a signal SRk−1, and outputs a signal SRk which is generated by the shifting of the signal SRk−1.

The buffering circuits $\mathbf{221}_1$ to $\mathbf{221}_k$ receive the signals SR1 to SRk output from the respective flip-flops $\mathbf{211}_1$ to $\mathbf{211}_k$, respectively buffer the signals, and respectively output the signals BF1 to BFk.

The demultiplexer 230 includes the plurality of switching circuits $\mathbf{231}_1$ to $\mathbf{231}_k$. The switching circuit $\mathbf{231}_1$ is turned on when the signal BF1 is received, and respectively outputs twenty-four data signals received through respective eight red, green, and blue data buses (total of twenty-four bus lines) to data lines D1 to D24. In the like manner, the switching circuit $\mathbf{231}_2$ is turned on when the signal BF2 is received, and respectively outputs the twenty-four data signals received through the respective eight red, green, and blue data buses (total of twenty-four bus line) to data lines D25 to D48.

In the data driver according to the exemplary embodiment of the present invention, a test pad 250 is provided at each of the respective output terminals of the buffering circuits $\mathbf{221}_1$ to $\mathbf{221}_k$ in order to test any delay(s) or any distortion(s) of the signals SR1 to SRk output from the shift register 210.

Figure 5:
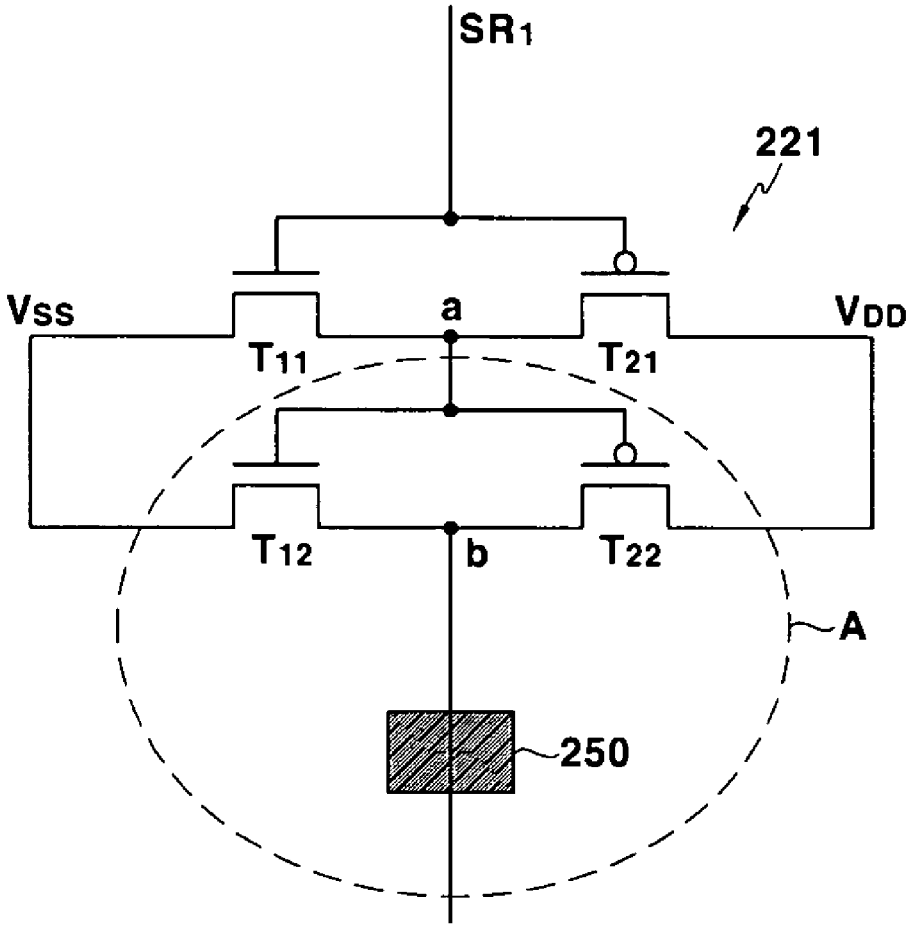
FIG. 5 shows a detailed diagram for representing the buffering circuit, and the test pad provided to the output terminal of the buffering circuit of FIG. 4.

FIG. 5 shows a detailed diagram for representing the buffering circuit 221 (e.g., the buffering circuit $\mathbf{221}_1$), and the test pad 250 (e.g., the test paid $\mathbf{250}_1$) provided at the output terminal of the buffering circuit 221.

As shown in FIG. 5, the buffering circuit 221 includes two n-transistors T11 and T12, and two p-transistors T21 and T22.

When the signal SR1 is at the low level, the transistor T11 is turned off, the transistor T21 is turned on, and a voltage of VDD is applied to a node a. The voltage of VDD, which is a high level potential of the node a, is applied to gates of the transistor T12 and the transistor T22. The transistor T12 is turned on, the transistor T22 is turned off, a voltage of VSS, which is a low level potential, is applied to a node b, and therefore the output terminal of the buffering circuit 221 is at the low level VSS. Accordingly, the test pad 250 is provided to the node b for the purpose of testing the operation of the buffering circuit 221.

Figure 6:
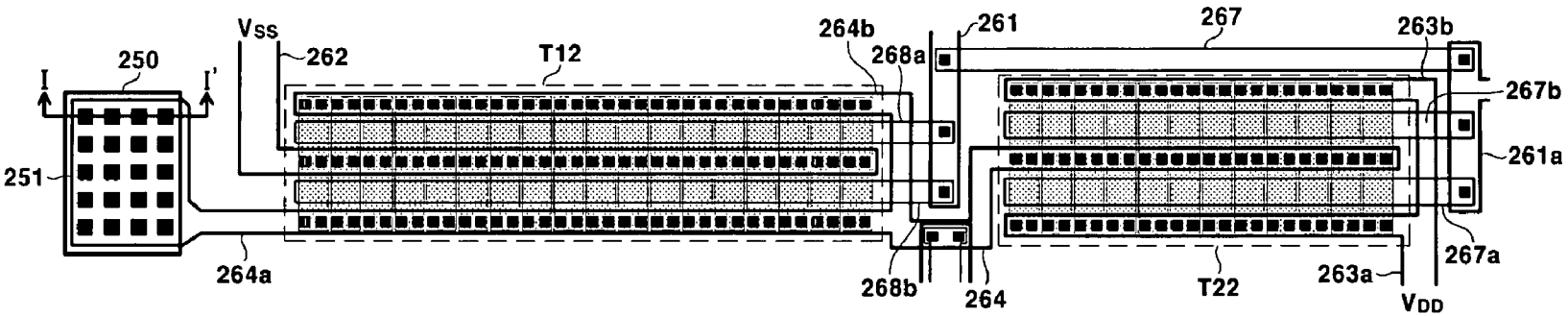
FIG. 6 shows a configuration in which an area A (shown in FIG. 5) of the test pad and the buffering unit of FIG. 5 is arranged on a substrate.

FIG. 6 shows a configuration in which an area A (shown in FIG. 5) of the test pad 250 and the buffering unit 221 is arranged on the substrate 100.

As shown in FIG. 6, based on an electrode line 261 forming the node a, the transistor T12 is extended and arranged in the row direction to the left of the electrode line 261, and the transistor T22 is extended and arranged in the row direction to the right of the electrode line 261. The electrode 261 is coupled to gate lines 268*a* and 268*b* of the transistor T12. The electrode 261 is also coupled to gate lines 267*a* and 267*b* through an electrode line 267 and an electrode line 261*a*. That is, a signal applied to the node a is transmitted to the gate lines 268*a* and 268*b* of the transistor T12 and the gate lines 267*a* and 267*b* of the transistor T22.

The power voltage VSS which is the low level potential is applied to an electrode line 262 corresponding to a source of the transistor T12, and the power voltage VDD which is high level potential is applied to electrode lines 263*a* and 263*b* corresponding to a source of the transistor T22. Electrode lines 264*a* and 264*b* corresponding to a drain of the transistor T12, and an electrode line 264 corresponding to a drain of the transistor T22 which are output terminals output the signal BF1.

A test pad 250 is formed at a terminal of the electrode line 264*a* forming an output terminal. The electrode line 264*a* forming an output terminal as the drain of the transistor T12 is extended and formed in a rectangular shape and the test pad 250 is formed to be coupled to the electrode line 264*a*.

Figure 7:
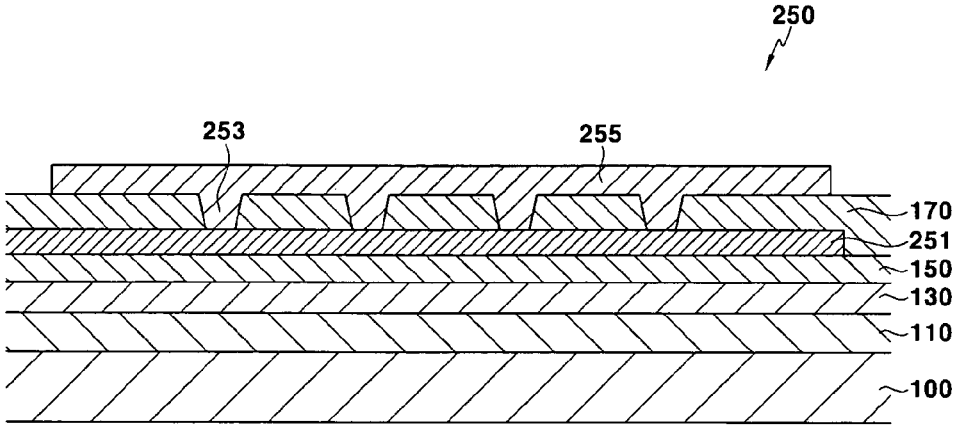
FIG. 7 shows a cross-sectional view of the test pad taken along the line I-I' of FIG. 6.

FIG. 7 shows a cross-sectional view of the test pad 250 taken along the line I-I' of FIG. 6.

As shown in FIG. 7, a blocking layer 110 is formed on the substrate 100, semiconductor layers including a source and a drain of a transistor, and a channel area are formed on the blocking layer 110, and a gate insulator film 130 is formed on the semiconductor layer. A gate layer including electrode lines including a gate of the transistor is formed on the gate insulator film 130. An insulator film between layers 150 is formed on the gate layer. The semiconductor layer and the gate layer are not provided where the test pad 250 is arranged, and therefore are not illustrated.

A source-drain layer including connection electrodes and data lines coupling sources and drains of transistors is formed on the insulator film between layers 150. In FIG. 7, the electrode 264*a* of FIG. 6 can be represented as the source-drain layer. An electrode 251 is formed being coupled to the electrode line 264*a*. A flattening film 170 is formed on the electrode 251. A test pad electrode 255 is formed to be coupled to the electrode 251 through a plurality of contact holes 253. Accordingly, the test pad 250 coupled to the output terminal of the buffering circuit 221 is completed.

Because of the embodiment of FIGS. 4, 5, 6, and 7, the operation of the COG type light emitting display can be tested before its completion because the output power of the shift register 210 may be tested by the test pad 250 coupled to the output terminal of the buffering circuit 221. Accordingly, a wasteful manufacturing cost caused by completing a defective display is reduced.

A second exemplary embodiment of the present invention will be described with reference to FIG. 8 to FIG. 10.

The second exemplary embodiment of the present invention corresponds to the first exemplary embodiment of the present invention except that a test pad 260 is provided to each of the respective output terminals of the switching circuits $\mathbf{231}_1$ to $\mathbf{231}_k$.

Figure 8:
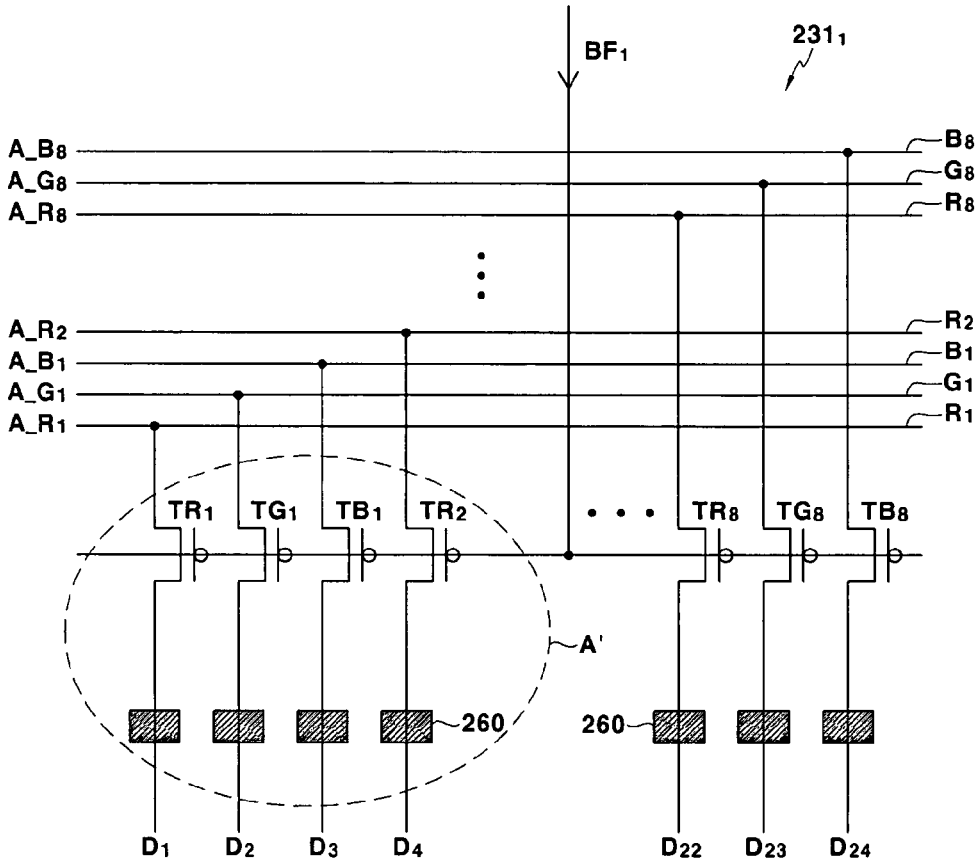
FIG. 8 shows a detailed diagram for representing the switching circuit, and a test pad provided to the output terminal of the switching circuit of FIG. 4 according to a second exemplary embodiment of the present invention.

FIG. 8 shows a detailed diagram for representing the switching circuit $\mathbf{231}_1$, and a test pad 260 provided to an output terminal of the switching circuit $\mathbf{231}_1$.

As shown in FIG. 8, the switching circuit $\mathbf{231}_1$ includes switching elements corresponding to a number of data buses R1, G1, B1 through R8, G8, and B8. That is, in the switching circuit $\mathbf{231}_1$, a source is coupled to the respective data buses R1, G1, B1 through R8, G8, and B8 when the red, green, and blue data signals A_R (e.g., A_R1, A_R2, A_R8, etc.), A_G (e.g., A_G1, A_G2, A_G8, etc.), and A_B (e.g., A_B1, A_B2, A_B8, etc.) are input through the twenty-four data buses R1, G1, B1 through R8, G8, and B8 that are eight data buses for the respective red, green, and blue. The switching circuit $\mathbf{231}_1$ includes twenty-four transistors TR1, TG1, TB1 through TR8, TG8, and TB8. The signal BF1 output from the buffering circuit $\mathbf{221}_1$ is applied to respective gates of the transistors TR1, TG1, TB1 through TR8, TG8, and TB8. In this exemplary embodiment of the present invention, the twenty-four transistors TR1, TG1, TB1 through TR8, TG8, and TB8 are p-type transistors.

In operation, the respective buffering circuits $\mathbf{221}_1$ to $\mathbf{221}_k$ sequentially output the signals BF1 to BFk having the low level. The twenty-four transistors (e.g., the transistors TR1, TG1, TB1 through TR8, TG8, and TB8) of each of the switching circuits $\mathbf{231}_1$ to $\mathbf{231}_k$ are turned on, and the data signals transmitted through the data buses (e.g., the data buses R1, G1, B1 through R8, G8, and B8) are applied to the data lines D1 to Dm.

In more detail, the low level signal BF1 is output from the buffering circuit $\mathbf{221}_1$, the low level is applied to the gates of the transistors TR1, TG1, TB1 through TR8, TG8, and TB8 of the switching circuit $\mathbf{231}_1$, and the transistors TR1, TG1, TB1 through TR8, TG8, and TB8 are turned on. Accordingly, the data signals A_R (e.g., A_R1, A_R2, A_R8, etc.), A_G (e.g., A_G1, A_G2, A_G8, etc.), and A_B (e.g., A_B1, A_B2, A_B8, etc.) transmitted through the data buses R1, G1, B1 through R8, G8, and B8 are respectively applied to the data lines D1 to D24. The low level signal BF2 is output from the buffering circuit $\mathbf{221}_2$, and the low level is applied to the gates of the transistors TR1, TG1, TB1 through TR8, TG8, and TB8 of the switching circuit $\mathbf{231}_2$.

Accordingly, the transistors TR1, TG1, TB1 through TR8, TG8, and TB8 are turned on, and the data signals A_R, A_G, and A_B transmitted through the data buses R1, G1, B1 through R8, G8, and B8 are respectively applied to the data lines D25 to D48. In a like manner, the low level signal BFk is output from the buffering circuit $\mathbf{221}_k$, the low level is applied to the gates of the transistors TR1, TG1, TB1 through TR8, TG8, and TB8 of the switching circuit $\mathbf{231}_k$, the transistors TR1, TG1, TB1 through TR8, TG8, and TB8 are turned on, and the data signals A_R, A_G, and A_B transmitted through the data buses R1, G1, B1 through R8, G8, and B8 are respectively applied to the data lines Dm-23 to Dm. As described, demultiplexer 230 applies a corresponding data signal to 24×k=m data lines $D_1$ to Dm by using twenty-four data buses R1, G1, B1 through R8, G8, and B8.

Also, in this exemplary embodiment of the present invention, the test pad 260 provided to each of the output terminals of the switching circuits $\mathbf{231}_1$ to $\mathbf{231}_k$ is for the purpose of testing the data signal output from the demultiplexer 230.

Figure 9:
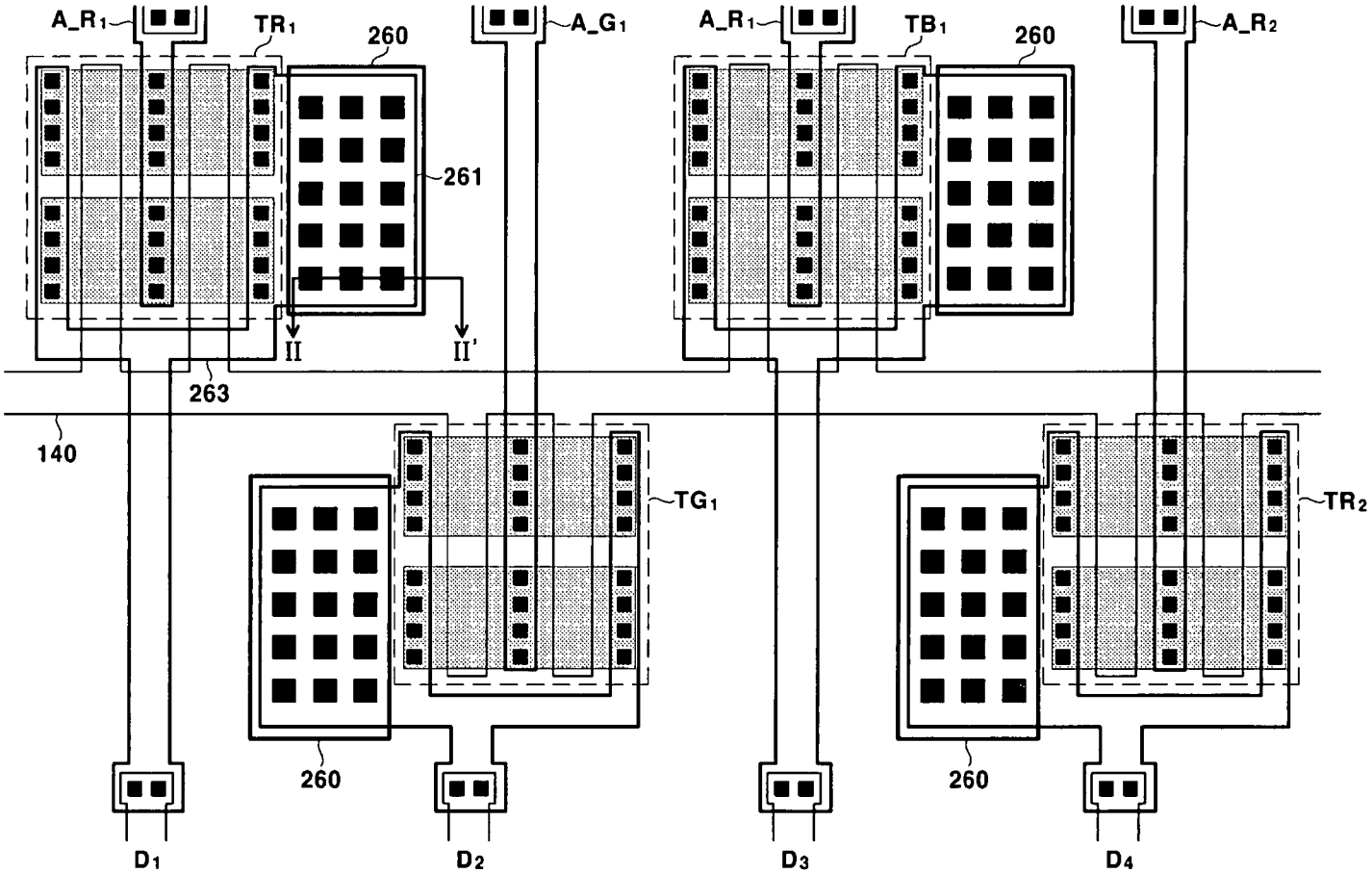
FIG. 9 shows a configuration in which an area A' of the test pad and the buffering unit of FIG. 8 is arranged on the substrate.

FIG. 9 shows a configuration in which an area A' of the test pads 260 and the switching circuit $\mathbf{231}_1$ of FIG. 8 is arranged on the substrate.

An electrode line coupled to a source of the transistor TR1 is formed being coupled to a data bus A_R1. An electrode line 263 coupled to a drain of the transistor TR1 is formed being coupled to a data line D1, and a data line for transmitting the signal BF1 is formed being coupled to a gate of the transistor TR1. Accordingly, the transistor TR1 is turned on with response to the low level signal BF1 transmitted by the electrode line 140, and transmits the data signal applied from the data bus A_R1 to the data line D1. Also, an electrode 261 is extended and formed by being coupled to the electrode line 263 coupled to the drain of the transistor TR1. The test pad 260 of the transistor TR1 coupled to the electrode 261 through a plurality of contact holes is formed while being insulated and overlapped with the electrode 261.

In a manner similar to above, the test pads 260 of the transistors TG1, TB1, and TR2 are formed.

Figure 10:
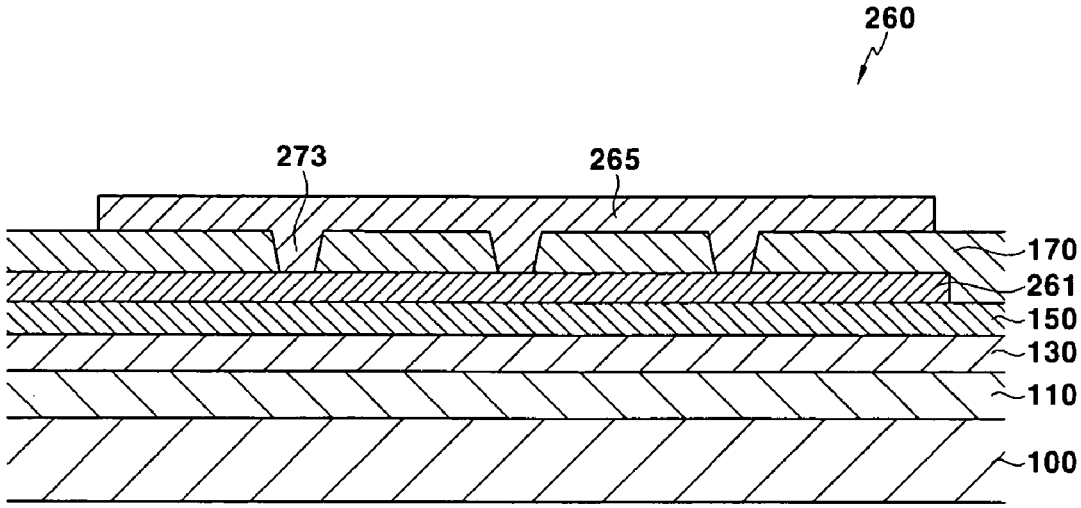
FIG. 10 shows a cross-sectional view of the test pad taken along the line II-II' of FIG. 9.

FIG. 10 shows a cross-sectional view of the test pad 260 taken along the line II-II' of FIG. 9.

As shown in FIG. 10, a blocking layer 110 is formed on the substrate 100, semiconductor layers including a source and a drain of a transistor, and a channel area are formed on the blocking layer 110, and a gate insulator film 130 is formed on the semiconductor layer. A gate layer including electrode lines including a gate of the transistor is formed on the gate insulator film 130. An insulator film between layers 150 is formed on the gate layer. The semiconductor layer and the gate layer are not provided where the test pad 260 is arranged, and therefore are not illustrated.

A source-drain layer including connection electrodes and data lines coupling sources and drains of transistors is formed on the insulator film between layers 150. In FIG. 10, the electrode line 263 of FIG. 9 can be represented as the source-drain layer. An electrode 261 is formed being coupled to the electrode line 263. A flattening film 170 is formed on the electrode 261. A test pad electrode 265 is formed to be coupled to the electrode 261 through a plurality of contact holes 273. Accordingly, the test pad 260 coupled to the output terminal of the switching circuit 231 is completed.

Because of the embodiment of FIGS. 8, 9, and 10, the operation of the COG type light emitting display can be tested before its completion because the output power of the shift register 210 may be tested by forming the test pad 260 coupled to the output terminal of the switching circuit 231. Accordingly, a wasteful manufacturing cost caused by completing a defective display is reduced.

A third exemplary embodiment of the present invention will now be described with reference to FIG. 11 to FIG. 14.

In the third exemplary embodiment of the present invention, the test pad is provided to an output terminal of the flip-flop.

Figure 11:
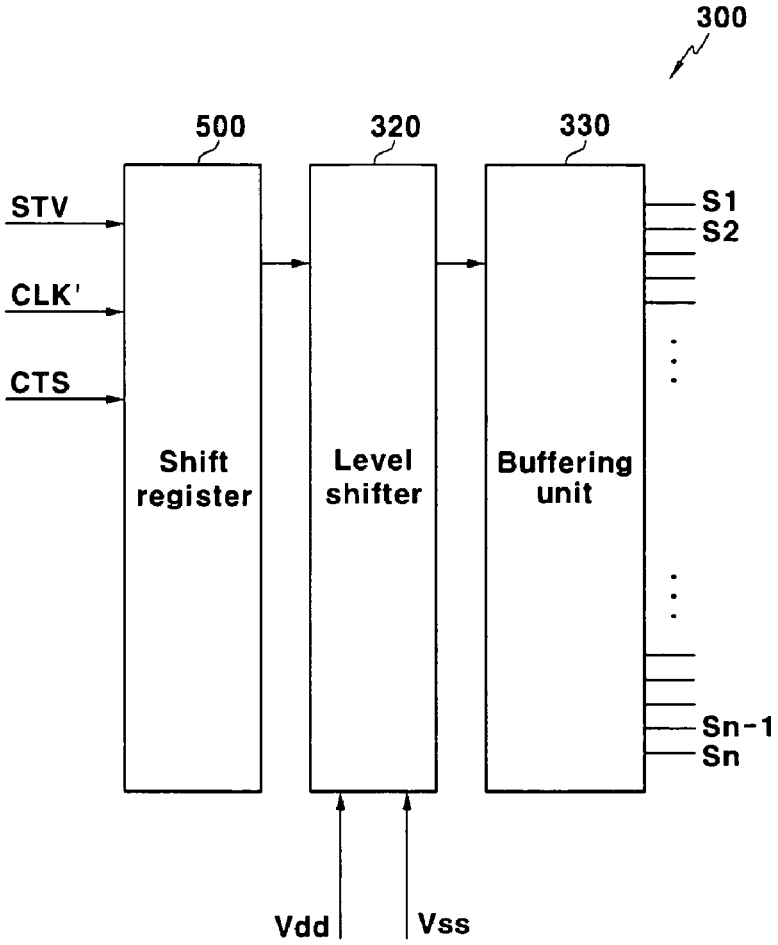
FIG. 11 schematically shows a configuration of the scan driver according to a third exemplary embodiment of the present invention.

FIG. 11 schematically shows a configuration of the scan driver 300 according to the third exemplary embodiment of the present invention.

The scan driver 300 shows a shift register 500, a level shifter 320, and a buffer or buffering unit 330.

The shift register 500 is a bi-directional shift register for a bi-directional scanning operation. The shift register 500 receives a start signal STV, a clock signal CLK', and a direction signal CTS from a controller (not illustrated); generates selection signals to be applied to respective scan lines S1 to Sn; and outputs the selection signals to the level shifter 320. The shift register 500 sequentially shifts the start signal STV, sequentially generates the selection signals to the respective scan lines S1 to Sn, and outputs the selection signals according to the input clock signal when the direction signal CTS is a forward signal. The shift register 500 shifts the start signal STV in a reverse direction, sequentially generates the selection signals to the respective scan lines Sn to S1, and outputs the selection signals according to the clock signal CLK when the direction signal CTS is a reverse signal.

The level shifter 320 receives power at voltage levels of Vdd and Vss from one or more power suppliers (not illustrated), and shifts the selection signals to the respective scan lines S1 to Sn input from the shift register 500 to a predetermined voltage level.

The buffer 330 buffers the selection signals to the respective scan lines S1 to Sn shifted to the predetermined voltage level, and applies them to the corresponding scan lines S1 to Sn of the display area 400.

Figure 12:
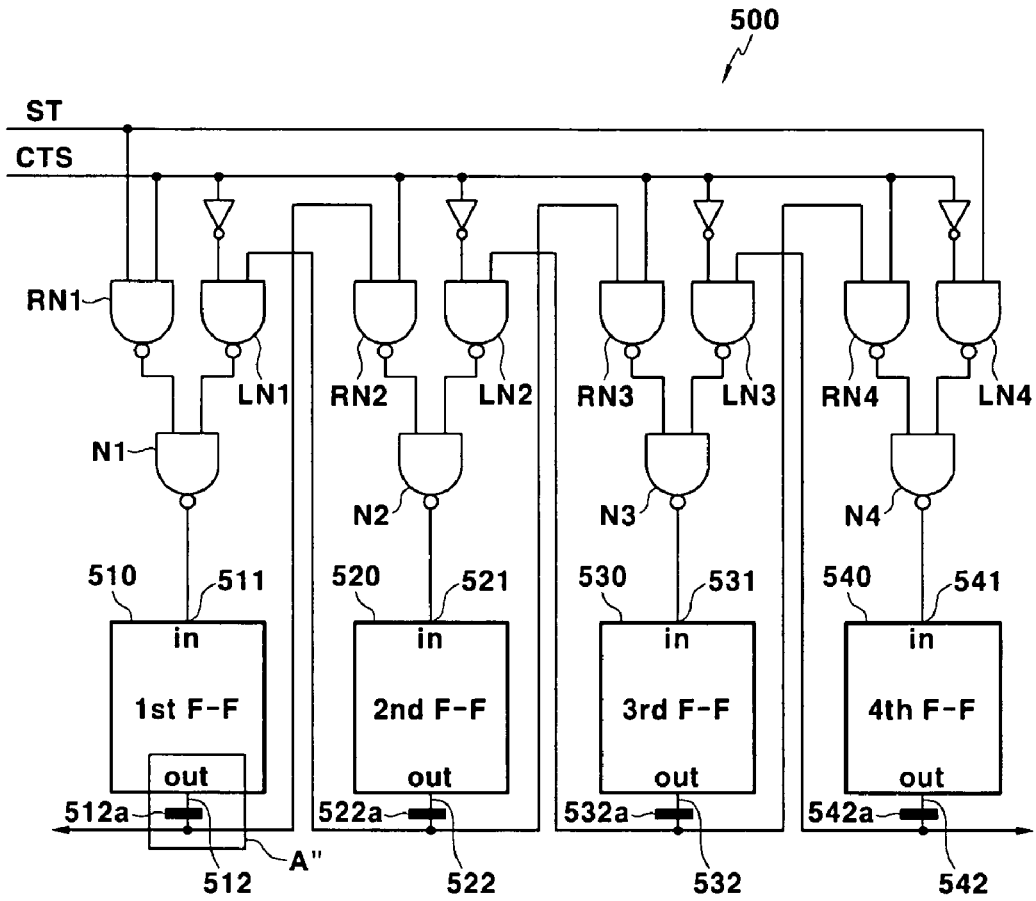
FIG. 12 shows a configuration of the shift register of FIG. 11.

FIG. 12 shows a configuration of the shift register 500.

In FIG. 12, an inversion signal for a signal that is inversed, is represented by using '/'. For example, an inversion signal of the start signal STV is represented by '/STV.'

The bi-directional shift register 500 includes a plurality of flip-flops 510 to 540, each including an input terminal and an output terminal; a plurality of forward NAND gates RN1 to RN4; a plurality of reverse NAND gates LN1 to LN4; and a plurality of NAND gates N1 to N4.

While the shift register used in the scan driver 300 and the data driver 200 of FIG. 2 can each respectively include as many flip-flops as the number of the scan lines and the data lines, it will be described such that the shift register includes four flip-flops in this exemplary embodiment of the present invention for convenience of description. The forward direction will be referred to when a signal is transmitted from the flip-flop 510 to the flip-flop 540 through the flip-flops 520 and 530, and the reverse direction will be referred to when a signal is transmitted from the flip-flop 540 to the flip-flop 510 through the flip-flops 520 and 530.

The forward NAND gate RN1 receives a start signal STV and a control signal, and the reverse NAND gate LN1 receives an inversion signal /CTS of the control signal CTS and an output signal of the flip-flop 520. The NAND gate N1 receives outputs of the forward NAND gate RN1 and the reverse NAND gate LN1. The flip-flop 510 receives an output of the NAND gate N1 through an input terminal 511.

The forward NAND gate RN2 receives an output signal of the flip-flop 510 through an output terminal 512. That is, the forward NAND gate RN2 receives the output signal of the flip-flop 510 and the control signal CTS. The reverse NAND gate LN2 receives the inversion signal /CTS of the control signal CTS and an output signal of the flip-flop 530. The NAND gate N2 receives outputs of the forward NAND gate RN2 and the reverse NAND gate LN2, and the flip-flop 520 receives an output of the NAND gate N2 through an input terminal 521.

The forward NAND gate RN3 receives an output signal of the flip-flop 520 through an output terminal 522. That is, the forward NAND gate RN3 receives the output signal of the flip-flop 520 and the control signal CTS. The reverse NAND gate LN3 receives the inversion signal /CTS of the control signal CTS and an output signal of the flip-flop 540. The NAND gate N3 receives outputs of the forward NAND gate RN3 and the reverse NAND gate LN3, and the flip-flop 530 receives an output of the NAND gate N3 through an input terminal 531.

The forward NAND gate RN4 receives an output signal of the flip-flop 530 through an output terminal 532. That is, the forward NAND gate RN4 receives the output signal of the flip-flop 530 and the control signal CTS. The reverse NAND gate LN4 receives the inversion signal /CTS of the control signal CTS and the start signal STV. The NAND gate N4 receives outputs of the forward NAND gate RN4 and the reverse NAND gate LN4, and the flip-flop 540 receives an output of the NAND gate N4 through an input terminal 541.

When a signal is output in the forward direction, the start signal STV is sequentially transmitted from the flip-flop 510 to the flip-flop 540 through the flip-flops 520 and 530, and the respective flip-flops 510 to 540 output a delayed signal with reference to the clock signal.

When a signal is output in the reverse direction, the start signal STV is sequentially transmitted from the flip-flop 540 to the flip-flop 510 through the flip-flops 530 and 520 in the reverse direction, and the respective flip-flops 540 to 510 output a delayed signal with reference to the clock signal.

Test pads 512*a*, 522*a*, 532*a*, and 542*a* for testing an output signal are provided in the respective output terminals 512, 522, 532, and 542 of the shift register 500.

Figure 13:
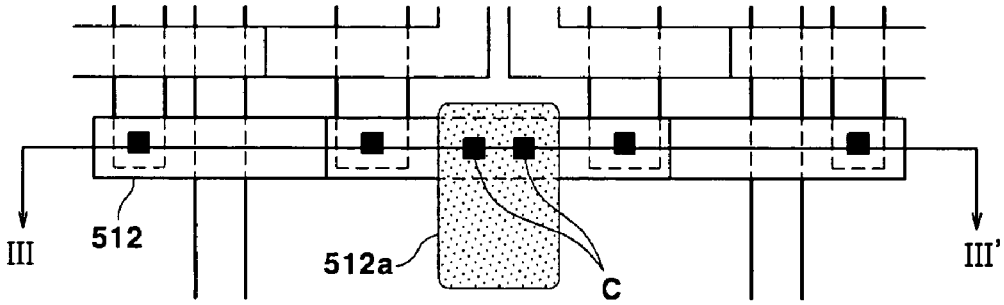
FIG. 13 shows a configuration in which an area A" of FIG. 12 is arranged.
Figure 14:
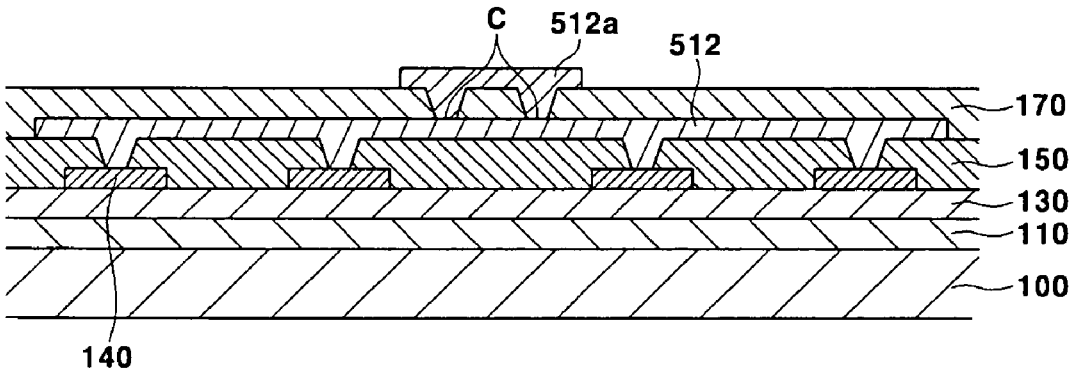
FIG. 14 shows a cross-sectional view of a part taken along the line III-III' of FIG. 13.
Figure 15:
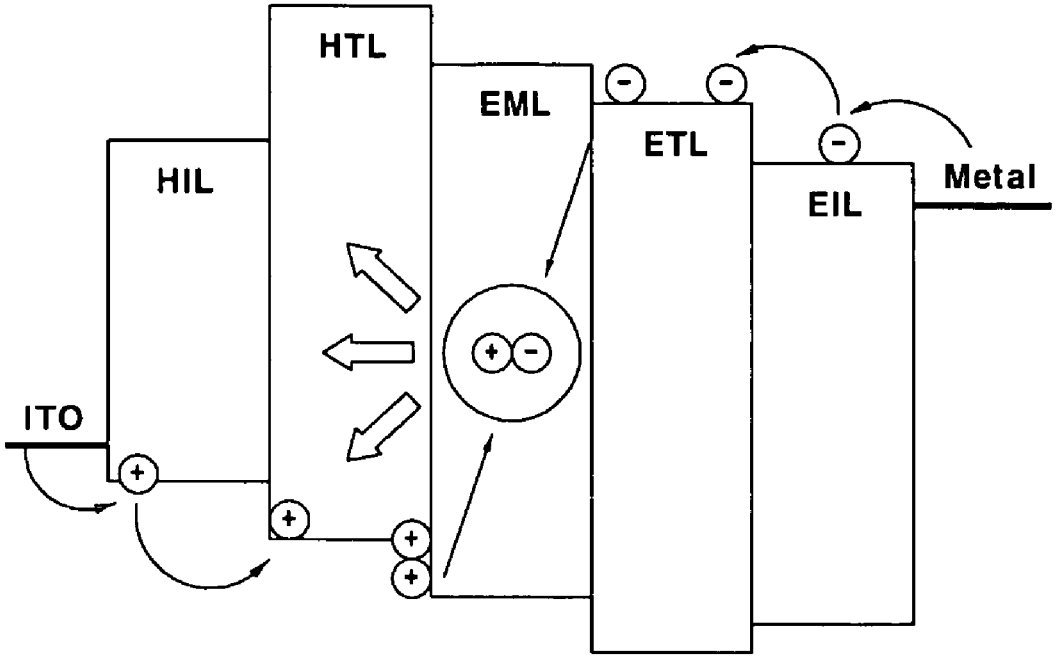
FIG. 15 schematically shows a structure of an organic light emitting cell.

FIG. 13 shows a configuration in an area A" of FIG. 12, and FIG. 14 shows a cross-sectional view of a part taken along the line of FIG. 13.

As shown in FIG. 13, the output terminal 512 of the flip-flop 510 is extended and formed, and the test pad 512*a* is formed in a center of the output terminal 512 in a rectangular form.

As shown in FIG. 14, a blocking layer 110 is formed on the substrate 100; semiconductor layers including a source and a drain of a transistor, and a channel area are formed on the blocking layer 110; and a gate insulator film 130 is formed on the semiconductor layer. The semiconductor layer and the gate layer are not provided where the test pad 512*a* is arranged, and therefore are not illustrated. A gate layer including electrode lines including a gate of the transistor is formed on the gate insulator film 130. An insulator film between layers 150 is formed on the gate layer.

A source-drain layer including connection electrodes and data lines coupling sources and drains of transistors is formed on the insulator film between layers 150. In FIG. 14, the electrode line 512 is formed as the source-drain layer. A flattening film 170 is formed on the electrode 512. A test pad electrode 512*a* is formed to be coupled to the electrode 512 through a plurality of contact holes C. Accordingly, the test pad 512*a* coupled to the output terminal 512 of the flip-flop 510 is completed.

Because of the embodiment of FIGS. 11, 12, 13, and 14, the operation of the COG type light emitting display may be tested before its completion because the output power of the shift register may be tested by forming the test pad 512*a* coupled to the output terminal of the buffering circuit 221. Accordingly, a wasteful manufacturing cost caused by completing a defective display is reduced According to the present invention, an output of a shift register may be tested by providing a test circuit to an output terminal of a buffering circuit for buffering the signal of the shift register of a data driver. Accordingly, the operation of the data driver may be tested before its completion in the COG type or SOP type light emitting display. Accordingly, a wasteful manufacturing cost caused by completing a defective display is reduced.

While the invention has been described in connection with certain exemplary embodiments, it is to be understood by those skilled in the art that the invention is not limited to the disclosed embodiments, but, on the contrary, is intended to cover various modifications included within the spirit and scope of the appended claims and equivalents thereof.

What is claimed is:

1. A light emitting display comprising:

a display area including a plurality of scan lines for transmitting selection signals, a plurality of data lines for transmitting data signals, and a plurality of pixels arranged in a matrix format and coupled to the scan lines and the data lines, the display area being on a substrate;

a scan driver for generating the selection signals and for applying the selection signals to the scan lines, the scan driver being on the substrate; and a data driver for generating the data signals and for applying the data signals to the data lines, the data driver being on the substrate, wherein the data driver comprises:

a shift register for generating shift signals shifted to sequentially have a first level and for outputting the shift signals through a plurality of output terminals;

a plurality of test pads, each test pad of the plurality of test pads coupled to a corresponding output terminal of the plurality of output terminals of the shift register;

a demultiplexer for selectively applying the data signals input through a plurality of data buses to the data lines in response to the first level of the shift signals; and a buffer coupled between the output terminals of the shift register and the test pads, the buffer being for buffering the shift signals sequentially having the first level, wherein the buffer comprises a plurality of buffering circuits, and wherein each of the plurality of buffering circuits is for outputting a first power voltage level when at least one of the shift signals input to the buffer is at the first level and for outputting a second power voltage level when the at least one of the shift signals is at a second level, and wherein at least one of the test pads is coupled to an output terminal of at least one of the buffering circuits, and arranged between an area of the substrate in which the at least one of the buffering circuits is arranged and another area of the substrate in which a neighboring one of the buffering circuits is arranged.

2. The light emitting display of claim 1, wherein an electrode line for forming the output terminal of the at least one of the buffering circuits is extended to a predetermined area, and the at least one of the test pads is coupled to the electrode line through a plurality of contact holes of an insulation film between the at least one of the test pads and the electrode line with the at least one of the test pads overlapping the predetermined area of the electrode line.

3. A light emitting display panel comprising:

a plurality of scan lines for transmitting selection signals;

a plurality of data lines for transmitting data signals;

a plurality of pixels coupled to the scan lines and the data lines, and arranged in a matrix format; and a data driver for generating the data signals and for applying the data signals to the data lines, and wherein the data driver comprises:

a shift register for generating shift signals shifted to sequentially have a first level and for outputting the shift signals;

a buffer for buffering the shift signals output from the shift register, the buffer comprising a plurality of output terminals for outputting the buffered shift signals to be utilized for transmitting corresponding data signals; and a plurality of test pads, each test pad of the plurality of test pads coupled to a corresponding output terminal of the plurality of output terminals of the buffer, wherein an electrode line for forming at least one of the output terminals of the buffer is extended to a predetermined area spaced apart from the plurality of pixels, and at least one of the test pads is directly coupled to the electrode line through a plurality of contact holes of an insulation film between the at least one of the test pads and the electrode line with the at least one of the test pads overlapping the predetermined area of the electrode line.

4. A data driver formed on a pixel array substrate in which a pixel for displaying an image corresponding to a data signal applied through a data line is arranged in a matrix format with a plurality of other pixels, the data driver comprising:

a shift register for generating a plurality of shift signals shifted to sequentially have a first level and for outputting the shift signals;

a buffer including a plurality of buffering circuits for receiving the plurality of shift signals output from the shift register, the buffer being for buffering the shift signals and for outputting the buffered shift signals, the plurality of buffering circuits comprising a plurality of output terminals;

a plurality of test pads, each test pad of the plurality of test pads coupled to a corresponding output terminal of the plurality of output terminals of the plurality of buffering circuits; and a demultiplexer for selectively applying the data signal input through at least one of a plurality of data buses to the data line in response to the first level of at least one of the plurality of shift signals output from the buffer, wherein an electrode line for coupling at least one of the output terminals of at least one of the buffering circuits to the demultiplexer is extended to a predetermined area spaced apart from the pixel and the plurality of other pixels, and at least one of the test pads is directly coupled to the electrode line through a plurality of contact holes of an insulation film between the at least one of the test pads and the electrode line with the at least one of the test pads overlapping the predetermined area of the electrode line.

5. A light emitting display comprising:

a display area including a plurality of scan lines for transmitting selection signals, a plurality of data lines for transmitting data signals, and a plurality of pixels arranged in a matrix format and coupled to the scan lines and the data lines, the display area being on a substrate;

a scan driver for generating the selection signals and for applying the selection signals to the scan lines, the scan driver being on the substrate; and a data driver for generating the data signals and for respectively applying the data signals to the data lines, the data driver being on the substrate, wherein the data driver comprises:

a shift register for generating a plurality of shift signals shifted to sequentially have a first level and for respectively outputting the shift signals through a plurality of output terminals of the shift register;

a demultiplexer for selectively applying the data signals input through a plurality of data buses to the data lines through a plurality of output terminals of the demultiplexer in response to the first level of the shift signals; and a plurality of test pads, each test pad of the plurality of test pads coupled between a corresponding output terminal of the plurality of output terminals of the demultiplexer and a corresponding data line of the plurality of data lines, wherein at least one of the test pads is directly coupled to an extended electrode line coupled to at least one of the output terminals of the demultiplexer, the extended electrode line spaced apart from the plurality of pixels, the at least one of the test pads being coupled to the extended electrode line through a plurality of contact holes of an insulation film between the at least one of the test pads and the electrode line with the at least one of the test pads overlapping the electrode line.

6. The light emitting display of claim 5, wherein the demultiplexer is a switching circuit comprising a plurality of switches for turning on in response to the first level of the shift signals to electrically couple the data lines to the data buses.

7. The light emitting display of claim 6, wherein each of the switches comprises a transistor having a first main electrode coupled to a respective one of the data buses, a second main electrode coupled to a respective one of the data lines, and a control electrode coupled to the shift register.

8. The light emitting display of claim 6, wherein the plurality of switches comprises a first switch and a second switch, and the first switch is arranged closer to a respective one of the data lines of the first switch than the second switch is arranged to a respective one of the data lines of the second switch.

9. The light emitting display of claim 8, wherein the second switch is arranged closer to a respective one of the data buses of the second switch than the first switch is arranged to a respective one of the data buses of the first switch.

10. A data driver on a pixel array substrate in which a pixel displaying an image corresponding to a data signal applied through a data line is arranged in a matrix format with a plurality of other pixels, the data driver comprising:

a shift register for generating a plurality of shift signals shifted to sequentially have a first level and for outputting the shift signals;

a buffer including a plurality of buffering circuits for receiving the plurality of shift signals output from the shift register, the buffer being for buffering the shift signals and for outputting the buffered shift signals;

a demultiplexer for selectively applying the data signal input through at least one of a plurality of data buses to the data line through at least one of a plurality of output terminals of the demultiplexer in response to the first level of the shift signals output from the buffer; and a plurality of test pads, each test pad of the plurality of test pads coupled to a corresponding output terminal of the plurality of output terminals of the demultiplexer, wherein at least one test pad of the plurality of test pads is directly coupled to an extended electrode line coupled to the at least one output terminal coupling the demultiplexer to the data line, the extended electrode line spaced apart from the pixel and the plurality of other pixels, the at least one of the test pads being coupled to the extended electrode line through a plurality of contact holes of an insulation film between the at least one test pad and the extended electrode line with the at least one test pad overlapping the extended electrode line.

11. The data driver of claim 10, wherein the output terminals of the demultiplexer comprise a first output terminal and a second output terminal, the plurality of test pads comprises a first test pad coupled to the first output terminal and a second test pad coupled to the second output terminal, and the first test pad is closer to the plurality of pixels than the second test pad is to the plurality of pixels.

12. The data driver of claim 11, wherein the second test pad is arranged closer to one of the data buses than the first test pad is arranged to the one of the data buses.

13. A light emitting display comprising:

a display area including a plurality of scan lines for transmitting selection signals, a plurality of data lines for transmitting data signals, and a plurality of pixels arranged in a matrix format and coupled to the scan lines and the data lines, the display area being on a substrate;

a scan driver for generating the selection signals and for applying the selection signals to the scan lines, the scan driver being on the substrate; and a data driver for generating the data signals and for applying the data signals to the data lines, the data driver being on the substrate, wherein the scan driver comprises:

a shift register for generating the selection signals shifted to sequentially have a first level and for outputting the selection signals through a plurality of output terminals; and a plurality of test pads, each test pad of the plurality of test pads coupled to a corresponding output terminal of the plurality of output terminals of the shift register, wherein at least one test pad of the plurality of test pads is directly coupled to an electrode line coupling one of the output terminals to a corresponding one of the scan lines through a plurality of contact holes of an insulation film between the at least one test pad and the electrode line with the at least one test pad overlapping the electrode line in a region spaced apart from the plurality of pixels.

14. The light emitting display of claim 13, wherein the shift register is a bi-directional shift register.

* * * * *